United States Patent [19]

Büll

[11] 3,985,328

[45] Oct. 12, 1976

[54] PROP-AND-SHOE ASSEMBLIES OF SELF-ADVANCING MINE ROOF-SUPPORTS

[75] Inventor: Hans Büll, Wuppertal, Germany

[73] Assignee: Hermann Hemscheidt Maschinenfabrik, Bornberg, Germany

[22] Filed: Dec. 19, 1975

[21] Appl. No.: 642,618

[30] Foreign Application Priority Data

Dec. 21, 1974 Germany ..... 2461011

[52] U.S. Cl. ..... 248/354 H; 61/45 D

[51] Int. Cl.[2] ..... E21D 15/44

[58] Field of Search ..... 248/354 H, 357; 61/45 D

[56] References Cited

UNITED STATES PATENTS

| | | | |
|---|---|---|---|
| 3,201,943 | 8/1965 | Wilkenloh et al. | 61/45 D |
| 3,800,546 | 4/1974 | Holken | 248/357 X |
| 3,813,886 | 6/1974 | Alacchi | 248/357 X |
| 3,877,234 | 4/1975 | Martinko | 61/45 D |
| 3,883,179 | 5/1975 | Floter | 61/45 D X |
| 3,885,396 | 5/1975 | Snowden | 248/357 X |

*Primary Examiner*—J. Franklin Foss

*Attorney, Agent, or Firm*—Berman, Aisenberg & Platt

[57] ABSTRACT

A prop-and-shoe assembly of an hydraulic self-advancing mine roof-support unit, comprising an hydraulic prop having a bearing member at or near one end which is pivotally supported on a pivot on the shoe and having a tubular portion which slidingly embraces the bearing member, a chamber within the said tubular prop portion which permits longitudinal displacement of the prop with respect to the shoe by the admission of hydraulic fluid under pressure into the chamber, an abutment adjacent the lower end of the tubular prop portion, and a stop face against which the abutment is pushed by hydraulic fluid supplied to the chamber during operation of the assembly so as to bring the prop into a desired position with respect to the shoe.

6 Claims, 2 Drawing Figures

PROP-AND-SHOE ASSEMBLIES OF SELF-ADVANCING MINE ROOF-SUPPORTS

This invention relates to Prop-and-shoe assemblies of self-advancing mine roof-support systems wherein the foot of the prop is mounted in its shoe on a pivotal bearing.

In inclined seams mechanical or hydraulic jacks of various kinds are used to erect a prop of mine roof-support so that it is normal to the floor. The jacks are linked to points roughly midway up the prop and obtain purchase from a neighbouring group of props or from equipment on the mine floor. Such prop-adjusting means are complex and expensive and they call for careful and intelligent handling. Moreover, as jacks act along the line of their longitudinal axis, the accurate adjustment of the props of a mine roof support system may possibly call for the provision of several pairs of jacks.

It is an aim of the present invention to provide a prop-and-shoe assembly which permits the settin-up of the props in hydraulic self-advancing mine roof-support systems in such a manner that each individual prop of a roof-support unit can be easily adjusted without the use of jacks.

According to the invention, a prop-and-shoe assembly of an hydraulic self-advancing mine roof-support unit comprises an hydraulic prop having a bearing member at or near one end which is pivotally supported on a pivot on the shoe and having a tubular portion which slidingly embraces the bearing member, a chamber within the said tubular prop portion which permits longitudinal displacement of the prop with respect to the shoe by the admission of hydraulic fluid under pressure into the chamber, an abutment adjacent the lower end of the tubular prop portion, and a stop face against which thee abutment is pushed by hydraulic fluid supplied to the chamber during operation of the assembly so as to bring the prop into a desired position with respect to the shoe.

It will therefore be seen that, when hydraulic fluid under pressure is admitted into its respective chamber, each prop in a self-advancing roof-support unit is lifted with respect to its bearing member and the abutment is pushed against the stop face on the shoe. This results in the prop being forced into a position where it is normal with respect to the mine floor (or where it is in some other desired position with respect to the floor or its shoe).

Figure 1:
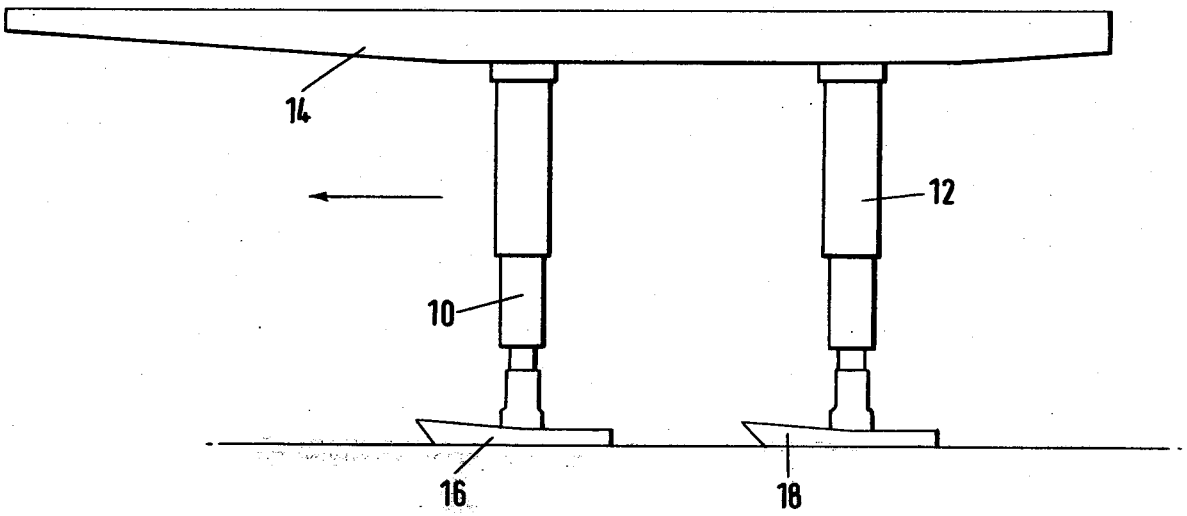
Figure 2:
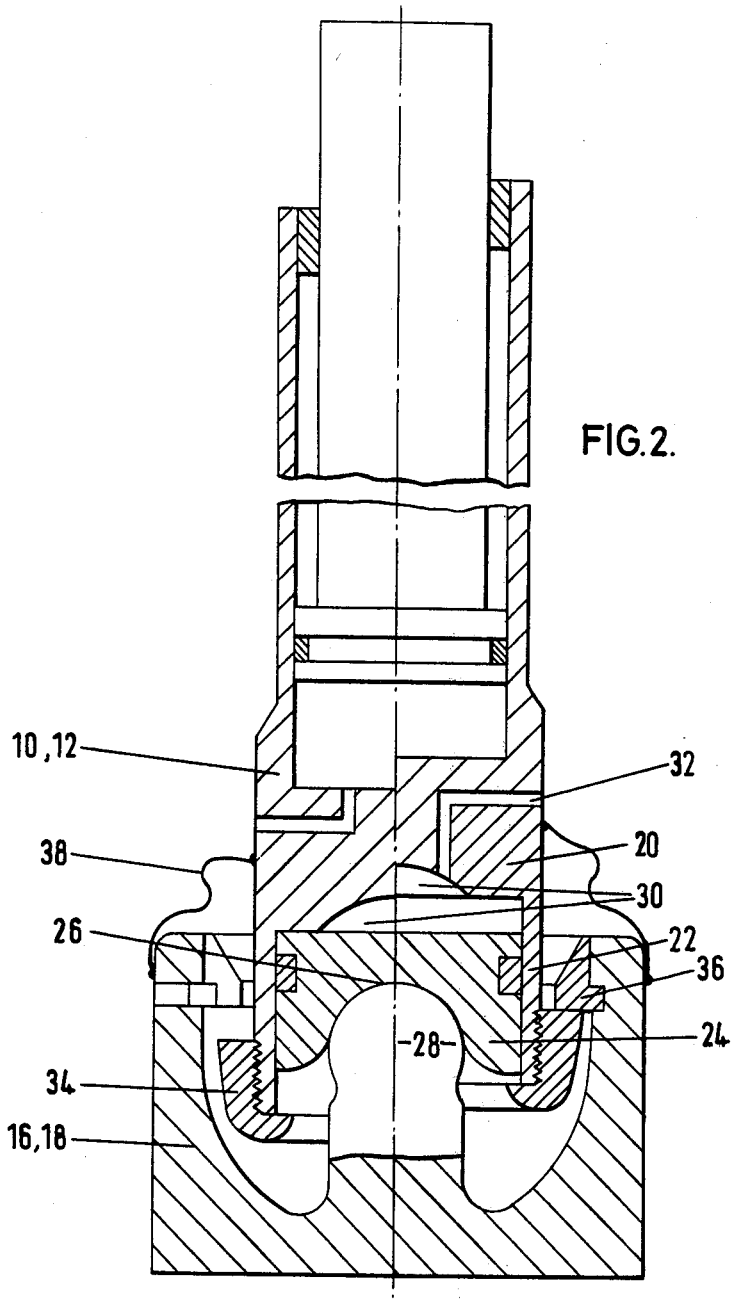

An example of an assembly in accordance with the invention is shown in the accompanying drawings, in which:

FIG. 1 is a side view of a self-advancing mine roof-support unit having two assemblies in accordance with the invention; and FIG. 2 is a longitudinal section through one of the props shown in FIG. 1, one half of the prop (the right-hand half) being shown in the raised position of the prop after hydraulic fluid under pressure has been admitted into the pressure chamber.

The illustrated self-advancing mine roof-support unit shown in FIG. 1 comprises two upright telescopic hydraulic props 10 and 12 of identical construction. At their upper ends they carry a roof-support beam 14. Their lower ends are each pivotally connected to respective shoes 16 and 18.

The two prop-and-shoe assemblies are illustrated in greater detail in FIG. 2. As will be seen, each prop 10,12 has, adjacent its foot 20, a tubular portion 22 which enters the hollow inside of the shoe 16,18 with lateral clearance. The tubular prop portion 22 contains a bearing member 24 formed with a downwardly-open socket 26 for the reception of a ball-shaped pivot pin 28 formed on the inside of the shoe 16,18. Bounded partially by the bearing member 24 and within the tubular prop portion 22 is a pressure chamber 30. Thus, by admitting fluid under pressure into this chamber 30 through an admission passage 32, the prop can be lifted with respect to its bearing member 24. This causes an abutment ring 34 which is screwed or otherwise fitted around the bottom end of the tubular prop portion 22 to be lifted into contact with a stop face on a stop 36 fitted inside the shoe 16,18, the prop thus being tightened and, at the same time, set up in a position normal to the floor.

To Prevent the ingress of dirt into the pivotal connection between the prop and its shoe, the gap between the foot of the prop and the shoe is protected by a bellows-type sock 38.

I claim:

1. A prop-and-shoe assembly of an hydraulic self-advancing mine roof support unit, comprising an hydraulic prop, a shoe operatively connected to an end of the prop, a bearing member adjacent the said end of the prop, a pivot on the shoe serving to pivotally support the said bearing member, a tubular portion of the prop slidably embracing the said bearing member, a chamber within said tubular prop portion permitting longitudinal displacement of the prop with respect to the shoe by the admission of hydraulic fluid under pressure into the chamber, an abutment adjacent the lower end of the said tubular prop portion, and a stop face on the shoe against which the said abutment is pushed by hydraulic fluid supplied to the said chamber during operation of the assembly whereby the prop is brought into a desired position with respect to the shoe.

2. A prop-and-shoe assembly as claimed in claim 1, wherein the pivot on the shoe is ball-shaped.

3. A prop-and-shoe assembly as claimed in claim 1, wherein the bearing member has a socket for receiving the pivot on the shoe.

4. A prop-and-shoe assembly as claimed in claim, wherein the chamber within said tubular prop portion is partially bounded by the said bearing member.

5. A prop-and-shoe assembly as claimed in claim 1, wherein the said abutment is formed on a ring fitted on the bottom end of the said tubular prop portion.

6. A prop-and-shoe assembly as claimed in claim 1, wherein the stop face is of annular shaped and is formed on a ring fitted on the shoe.

* * * * *